US008144078B2

(12) United States Patent
Goodart

(10) Patent No.: US 8,144,078 B2
(45) Date of Patent: Mar. 27, 2012

(54) ENHANCED BRIGHTNESS, COLOR AND CONTRAST CONTROL FOR CATHODE RAY TUBE MONITOR

(75) Inventor: Joseph Edgar Goodart, Austin, TX (US)

(73) Assignee: Dell Products L.P., Round Rock, TX (US)

( * ) Notice: Subject to any disclaimer, the term of this patent is extended or adjusted under 35 U.S.C. 154(b) by 775 days.

(21) Appl. No.: 12/211,339

(22) Filed: Sep. 16, 2008

(65) Prior Publication Data

US 2009/0009428 A1 Jan. 8, 2009

Related U.S. Application Data

(63) Continuation of application No. 10/385,138, filed on Mar. 10, 2003, now abandoned.

(51) Int. Cl.
*G09G 1/06* (2006.01)

(52) U.S. Cl. ..... 345/12; 345/13; 345/20; 315/364; 315/383; 315/368.17; 313/447

(58) Field of Classification Search ..... 345/11, 345/12, 20, 22, 13; 315/379, 380, 381, 1, 315/3, 5.24, 5.33, 5.34, 364, 383, 391, 368.11, 315/368.17; 348/576, 577, 808, 809, 380; 313/364, 421, 418, 446–448
See application file for complete search history.

(56) References Cited

U.S. PATENT DOCUMENTS

| | | | | |
|---|---|---|---|---|
| 3,336,587 | A | 8/1967 | Brown | 345/20 |
| 3,935,384 | A * | 1/1976 | Jirka | 348/625 |
| 4,670,784 | A | 6/1987 | Goldberg | 348/556 |
| 4,733,229 | A | 3/1988 | Whitehead | 345/20 |
| 4,924,522 | A | 5/1990 | Bray et al. | 382/237 |
| 5,565,897 | A | 10/1996 | Kikinis et al. | 345/213 |
| 5,793,166 | A * | 8/1998 | Vis et al. | 315/383 |
| 5,886,750 | A * | 3/1999 | Osuga et al. | 348/615 |
| 6,369,851 | B1 | 4/2002 | Marflak et al. | 348/173 |
| 2003/0001829 | A1 | 1/2003 | Tanizoe et al. | 345/204 |

FOREIGN PATENT DOCUMENTS

| | | |
|---|---|---|
| JP | 56-112184 | 9/1981 |
| JP | 02-274077 | 11/1990 |

OTHER PUBLICATIONS

"USB Monitor Control Class Specification," Revision 1.0, Jan. 5, 1998.
"VESA Monitor Control Command Set," Video Electronics Standards Association, Version 1.1, Draft 2, Dec. 2, 2002.
"Understanding the Operation of a CRT Monitor," National Semiconductor Corporation, 1995.

* cited by examiner

*Primary Examiner* — Lun-Yi Lao
*Assistant Examiner* — Tom Sheng
(74) *Attorney, Agent, or Firm* — Hamilton & Terrile, LLP; Gary W. Hamilton

(57) ABSTRACT

A method and apparatus for controlling brightness, color and contrast in CRT monitors used in information handling systems. In accordance with the present invention, a viewing area on a CRT monitor is enhanced by applying appropriate signals directly to the grids in the CRT. In one embodiment of the present invention, appropriate voltage signals are applied to the G1 grid of the CRT. Parameter data is provided to the CRT using a DDC2/CI data channel, with the parameter data being based on the VESA MCCS command set. Utilizing the method and apparatus of the present invention, it is possible to achieve significantly greater brightness, color and contrast control in enhanced viewing areas displayed on a CRT monitor used in an information handling system.

20 Claims, 4 Drawing Sheets

ENHANCED BRIGHTNESS, COLOR AND CONTRAST CONTROL FOR CATHODE RAY TUBE MONITOR

This application is a continuation of application Ser. No. 10/385,138, filed Mar. 10, 2003, now abandoned entitled "Enhanced Brightness, Color and Contrast Control for Cathode Ray Tube Monitor," inventor Joseph Edgar Goodart, which is incorporated by reference in its entirety.

BACKGROUND OF THE INVENTION

1. Field of the Invention

Present invention relates generally to monitors and displays used in information handling systems. More specifically, the present invention provides an improved method and apparatus for controlling the brightness, color and contrast in cathode ray tube monitors used in information handling systems.

2. Description of the Related Art

As the value and use of information continues to increase, individuals and businesses seek additional ways to process and store information. One option available to users is information handling systems. An information handling system generally processes, compiles, stores, and/or communicates information or data for business, personal, or other purposes thereby allowing users to take advantage of the value of the information. Because technology and information handling needs and requirements vary between different users or applications, information handling systems may also vary regarding what information is handled, how the information is handled, how much information is processed, stored, or communicated, and how quickly and efficiently the information may be processed, stored, or communicated. The variations in information handling systems allow for information handling systems to be general or configured for a specific user or specific use such as financial transaction processing, airline reservations, enterprise data storage, or global communications. In addition, information handling systems may include a variety of hardware and software components that may be configured to process, store, and communicate information and may include one or more computer systems, data storage systems, and networking systems.

One of the most important components of an information handling system is the video display, which is the principal user interface for both text and graphics. In recent years there has been a significant increase in the number of applications that require a video display capable of providing one or more enhanced viewing areas for displaying specialized applications. Examples of applications using enhanced viewing areas on a video display include: DVD movies, monitor/computer control functions, and sRGB display areas for e-commerce transactions.

There are numerous display technologies that have been introduced in recent years, including liquid crystal displays (LCDs), plasma displays, electroluminescent displays (EL) and light emitting diode (LED) displays. Despite the advances in the afore-mentioned technologies, the cathode ray tube (CRT) remains as one of the most common components for providing video displays in information handling systems. CRTs are capable of offering better contrast, luminance and resolution than any other display technology at a comparable price.

Prior art methods for providing an enhanced viewing area in a CRT involve adding signals from an enhanced video circuit to the signals driving the RGB cathodes of the CRT.

This design tends to result in an enhanced viewing area that has a smeared or lower quality video image.

SUMMARY OF THE INVENTION

In view of the shortcomings of the prior art, there is a need for an improved method and apparatus for controlling brightness, color and contrast in CRT monitors used in information handling systems. In accordance with the present invention, an improved method and apparatus is provided for enhancing a viewing area on a CRT monitor used with an information system by applying appropriate signals directly to the grids in the CRT rather than mixing the video enhancement signals together with the RGB signals used to drive the cathodes in the CRT. The information handling system of the present invention is broadly comprised of a processor, memory coupled to the processor, with said memory including instructions to generate a cathode ray tube user interface. The cathode ray tube comprises: a plurality of cathodes at a first end of said cathode ray tube, said plurality of cathodes being operable to emit electron beams; a anode at a second end of said cathode ray tube; a display area at a second end of said cathode ray tube, said display area being operable to generate a visible image in response to electron beams incident thereon; and at least one grid disposed between said plurality of cathodes and said anode, said grid being operable to control said electron beams thereby controlling the display characteristics of a visible image displayed on said cathode ray tube. The information handling system further comprises a first control circuit for controlling said plurality of cathodes; a second control circuit operable to apply a video enhancement signal to said grid at predetermined timing intervals to generate an enhanced viewing area on a portion of said display area of said cathode ray tube. In various embodiments of the present invention, appropriate voltage signals are applied to the G1 grid of the CRT. Parameter data can be provided to the CRT using a DDC 2CI data channel, with the parameter data being based on the VESA MCCS command set.

Utilizing the method and apparatus of the present invention, it is possible to achieve significantly greater brightness, color and contrast control in enhanced viewing areas displayed on a CRT monitor used in an information handling system.

BRIEF DESCRIPTION OF THE DRAWINGS

The present invention may be better understood, and its numerous objects, features and advantages made apparent to those skilled in the art by referencing the accompanying drawings. The use of the same reference number throughout the several figures designates a like or similar element.

DETAILED DESCRIPTION

Figure 1:
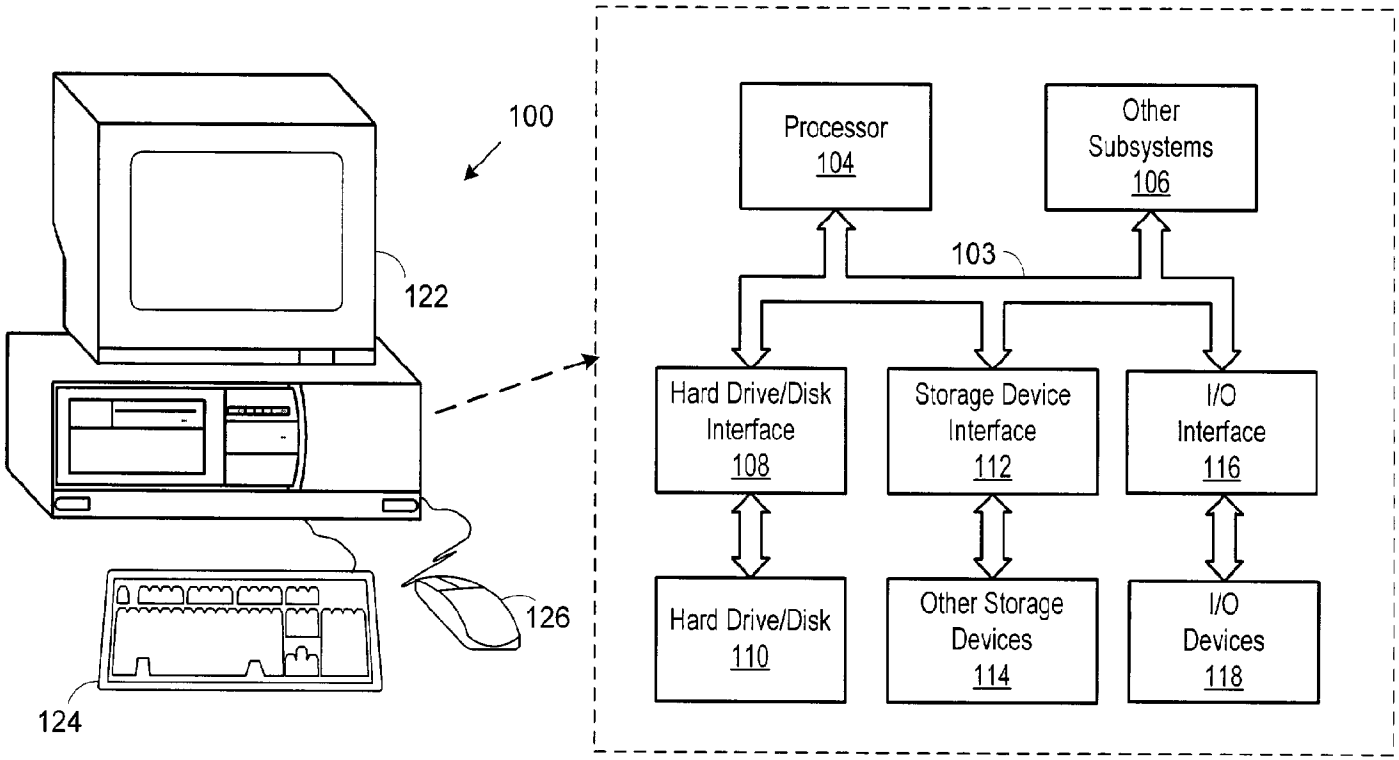
FIG. 1 is a general illustration of components of an information handling system containing video displays implementing the method and apparatus of the present invention.

The method and apparatus of the present invention provides significant improvements in the operation of monitors used in an information handling system 100 shown in FIG. 1.

For purposes of this disclosure, an information handling system may include any instrumentality or aggregate of instrumentalities operable to compute, classify, process, transmit, receive, retrieve, originate, switch, store, display, manifest, detect, record, reproduce, handle, or utilize any form of information, intelligence, or data for business, scientific, control, or other purposes. For example, an information handling system may be a personal computer, a network storage device, or any other suitable device and may vary in size, shape, performance, functionality, and price. The information handling system may include random access memory (RAM), one or more processing resources such as a central processing unit (CPU) or hardware or software control logic, ROM, and/or other types of nonvolatile memory. Additional components of the information handling system may include one or more disk drives, one or more network ports for communicating with external devices as well as various input and output (I/O) devices, such as a keyboard, a mouse, and a video display. The information handling system may also include one or more buses operable to transmit communications between the various hardware components.

Referring to FIG. 1, the information handling system 100 includes a processor 104 and various other subsystems 106 understood by those skilled in the art. Data is transferred between the various system components via various data buses illustrated generally by bus 103. A hard drive 110 is controlled by a hard drive/disk interface 108 that is operably connected to the hard drive/disk 110. Likewise, data transfer between the system components and other storage devices 114 is controlled by storage device interface 112 that is operably connected to the various other storage devices 114, such as CD ROM drives, floppy drives, etc. An input/output (I/O) interface 116 controls the transfer of data between the various system components and a plurality of input/output (I/O) devices 118, such as a display 122, a keyboard 124, a mouse 126.

Figure 2:
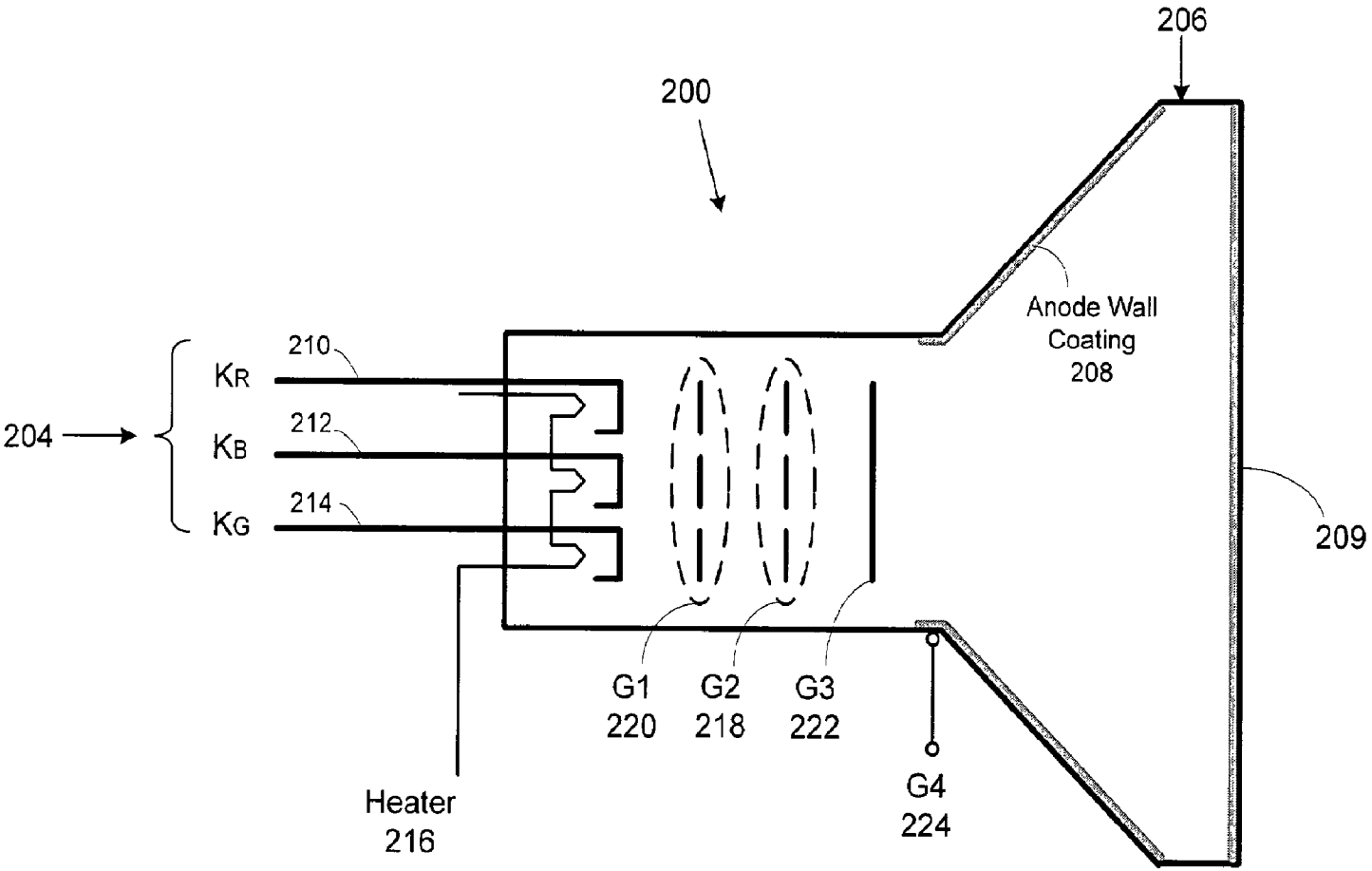
FIG. 2 is a cross-sectional view of the major components of a cathode ray tube for generating a video image.

FIG. 2 is a simplified cross-sectional illustration of the components of a cathode ray tube (CRT) 200 that is incorporated into the display 122 shown in FIG. 1. The CRT 200 includes a plurality of cathodes 204 that generate electron beams that are directed to the display end 206 of the CRT. As is well understood by those skilled in the art, the display end 206 of the CRT 200 comprises an anode wall coating 208. The plurality of cathodes 204 includes cathodes 210 ($K_R$), 212 ($K_G$), and 214 ($K_B$) that are used to generate electron beams corresponding, respectively, to red, green, and blue display signals. The heater 216 provides heat to the cathodes to aid in the emission of electrons. The interior portion of the CRT display area 209 is coated with a phosphorescent material that emits visible light upon impact from electrons emitted by the cathodes 204. A general description of the operation of a cathode ray tube display can be found in "Understanding the Operation of a CRT Monitor," Zahid Rahim, National Semiconductor Application Note 656, November, 1989, which by this reference is incorporated for all purposes.

An acceleration potential for the electrons beams is provided by a grid 218, referred to as "G2," that is at a potential of several hundred volts more positive than the cathodes 204. As the respective electron beams traverse the interior of the CRT 200 from the cathodes 204 toward the display area 209, the beams are shaped by a plurality of other grids. Grid 220, referred to as the "G1" grid or the "control grid" is at a potential of between 50 and several hundred volts more negative than the cathodes. The G1 grid 218 can be modulated to control the intensity of the electron beams thereby controlling the intensity of the image produced on the display area 208. The potential of grid 222, referred to as the "G3" grid, is adjusted to electrostatically focus the various electron beams on the viewing area 208. The anode wall coating 208 defines a grid 224, often referred to as "G4," which is typically held at a relatively high voltage, approximately 27.5 kV in many CRT monitors.

Figure 3:
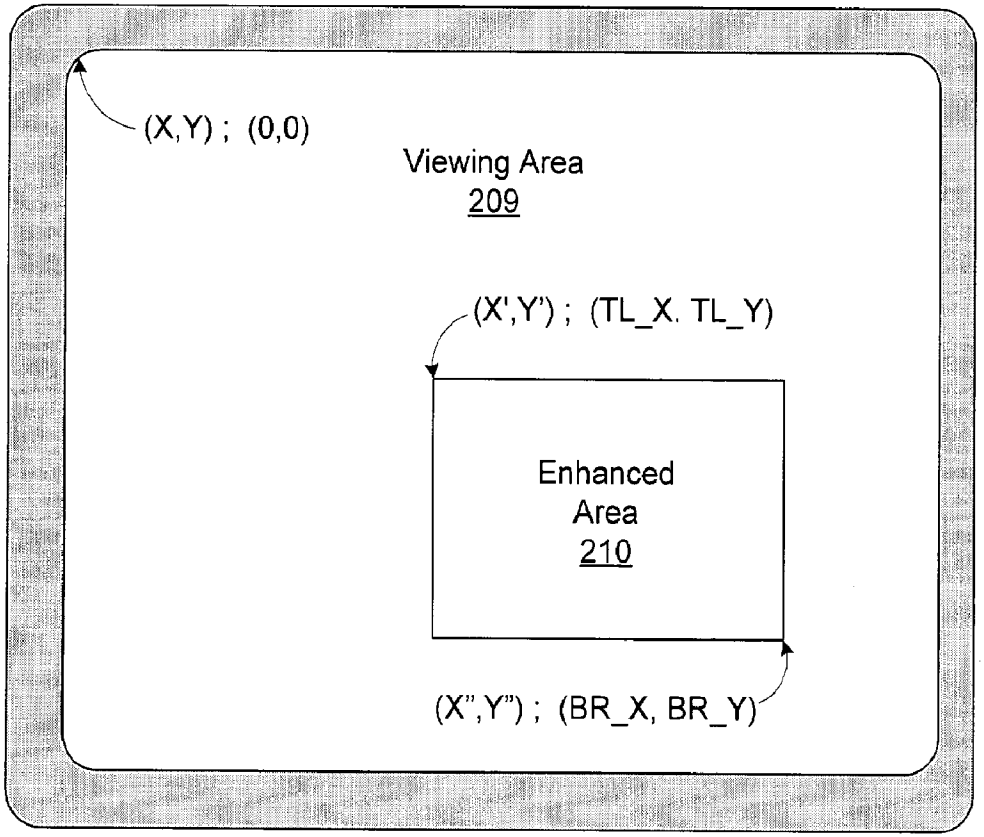
FIG. 3 is an illustration of a video display having an enhanced viewing area.

FIG. 3 is front view of the display area 209 of the CRT 200 illustrated in FIG. 2. The display area 209 can be defined as an X,Y coordinate system with the upper X,Y vertex designated as (0,0). An enhanced viewing area 210 is defined by an upper left-hand corner designated as X',Y' and a lower right hand corner designated as X",Y." The timing signals used to cause the electron beams to generate the enhanced area 210 are defined in "USB Monitor Control Class Specification, Revision 1.0" published by the USB Implementers Forum on Jan. 5, 1998, which by this reference is incorporated herein for all purposes. Other technical information for implementing the monitor control signals in accordance with the present invention can be found in "VESA Monitor Control Command Set (MCCS) Proposed Standard, Version 1.1, Draft 2," published on Dec. 2, 2002 by the Video Electronic Standards Association (hereinafter referred to as the VESA MCCS specification), which by this reference is incorporated herein for all purposes. In accordance with the VESA MCCS specification, the upper left corner of the enhanced area 210 is defined by TL_X, TL_Y; the lower right hand corner of the enhanced area 210 is defined by BR_X, BR_Y of the aforementioned VESA MCCS specification.

Figure 4:
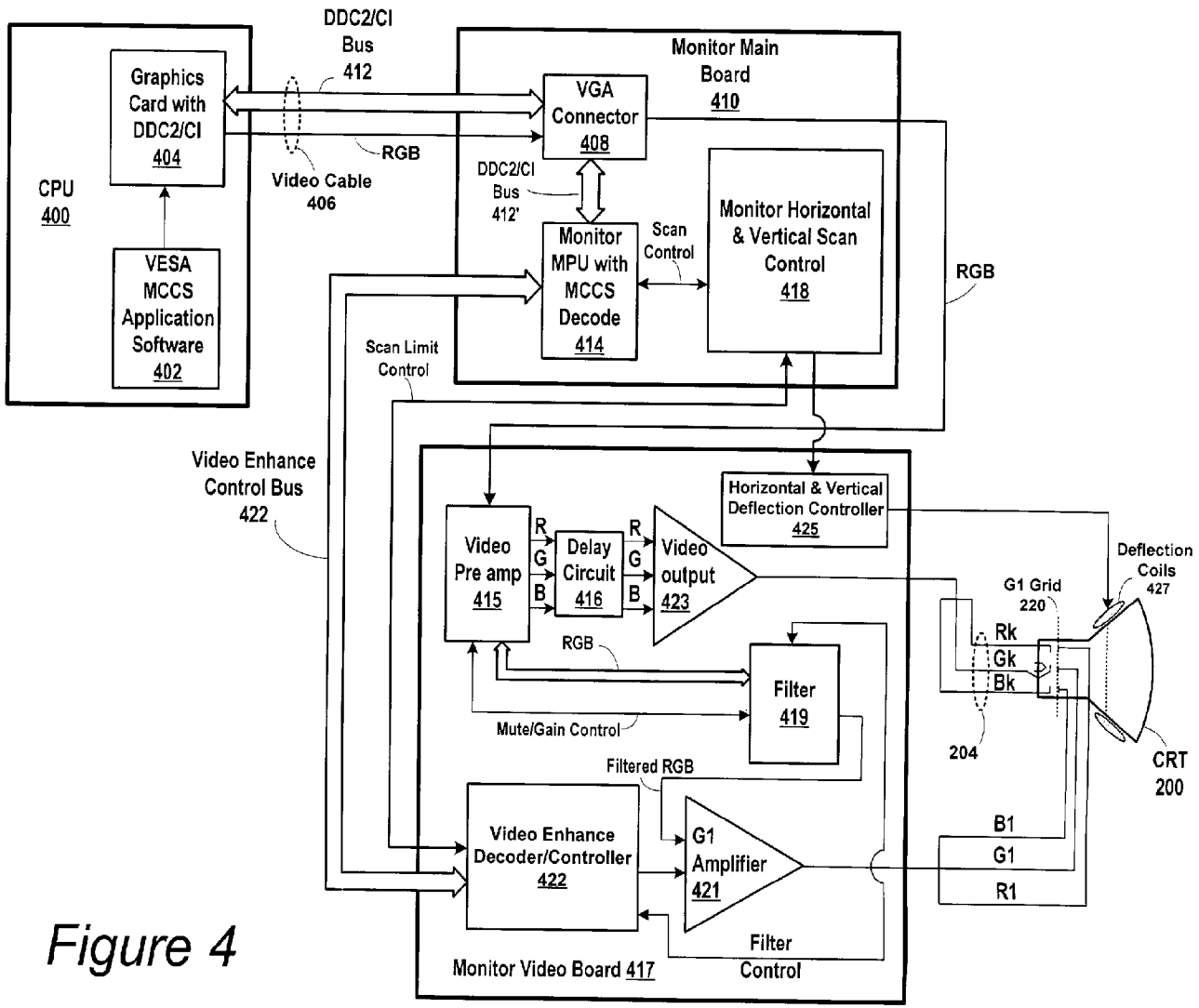
FIG. 4 is a block diagram of the system components for generating an enhanced viewing area on a video display in accordance with the present invention.

FIG. 4 is a system block diagram illustrating the system components for implementing the enhanced viewing area in a CRT monitor in accordance with the present invention. A CPU 400 comprises processing hardware and operating system software for implementing the VESA MCCS and appropriate application software 402. Examples of application software known to those of skill in the art includes software for showing MCCS commands and actions available to the display user and also can include vendor-specific software for generating screen menus that allow the user to make on-screen adjustments. The enhanced viewing area can be based on a user selectable area with the boundaries determined by the VESA MCCS coordinates described above or the enhanced area can be based on stored parameter such as parameters used to define vendor-specific on-screen menus.

The graphics card 404 is operable to implement the Display Data Channel 2/Command Interface (DDC2/CI). The graphics card 404 contains a processor that generates RGB control signals that are provided via video cable 406 to VGA connector 408 on the monitor main board 410. The RGB signals received by the VGA connector 408 are transmitted to the video preamp 415 on the monitor video main board 417. The RGB signals are amplified by the video pre-amp 415 and transmitted through the delay circuit 416 to the video output amplifier 423 that generates input signals for the cathodes 204 of the CRT 200. The delay circuit 416 provides an appropriate time delay to ensure that the Rk, Bk, Gk signals arrive at the cathodes 204 at the same time as the R1, G1, B1 signals are applied to the G1 grid 220. The video pre-amp 415 also transmits the amplified RGB signals and a mute/gain control signal to the filter 419 which is controlled by the video enhance decoder/controller 422 as will be discussed in greater detail below.

The processor on the graphics card 404 in the CPU 400 is operable to encode VESA MCCS commands which are transmitted to the monitor processing unit (MPU) 414 via a DDC2/CI buses 412 and 412' thereby providing appropriate commands to set the parameters for the enhanced area 210 of the display area 209 illustrated in FIG. 3. The MPU 414 decodes the VESA MCCS commands and operates in cooperation with the monitor horizontal & vertical scan control 418 to generate video enhancement control signals that are transmitted to the video enhance decoder/controller 422. Timing signals from the monitor horizontal & vertical scan control 418 are also transmitted to the horizontal & vertical deflection controller 425 which controls the voltage in the deflection coils 427 to generate a raster scan pattern for the electron beams generated by the cathodes 204.

The video enhance decoder/controller 422 decodes the incoming video enhancement signals and generates control signals to govern the operation of the filter 419 and the G1 amplifier 421. As was discussed above in connection with FIG. 3, the boundary coordinates of the desired enhanced viewing area can be encoded using the VESA MCCS command set. These commands are decoded by the MPU 414 and the video enhance decoder/controller 422 and control signals are generated to cause the G1 amplifier 421 to produce an enhancement signal that is applied to the G1 grid 220 in the CRT 200. Specifically, at appropriate timing intervals in accordance with the decoded VESA MCCS parameters, the video enhance decoder/controller 422 will cause the filter 419 to transmit filtered RGB signals to the G1 amplifier 421. These RGB signals are amplified by the G1 amplifier and are applied to the G1 grid in the CRT 200, thereby generating an enhanced viewing area on the CRT display as illustrated by the enhanced area 210 shown in FIG. 3.

Utilizing the method and apparatus of the present invention, it is possible to achieve significantly greater brightness, color and contrast control in enhanced viewing areas displayed on the CRT monitor 200 used in an information handling system. Although the present invention has been described in detail, it should be understood that various changes, substitutions and alterations can be made hereto without departing from the spirit and scope of the invention as defined by the appended claims.

What is claimed is:

1. A video display system for providing an enhanced viewing area, comprising:

a cathode ray tube further comprising:

a plurality of cathodes at a first end of said cathode ray tube, said plurality of cathodes being operable to emit electron beams;

an anode at a second end of said cathode ray tube;

a display area at a second end of said cathode ray tube, said display area operable to generate a visible image in response to electron beams incident thereon; and at least one grid disposed between said plurality of cathodes and said anode, said grid being operable to control said electron beams thereby controlling the display characteristics of a visible image displayed on said cathode ray tube;

a first control circuit for controlling said plurality of cathodes;

a second control circuit operable to apply video enhancement signals to said grid at predetermined timing intervals to generate an enhanced viewing area on a portion of said display area of said cathode ray tube;

wherein said first control circuit comprises a delay circuit operable to delay arrival of video signal at said plurality of cathodes to coincide with the arrival of corresponding video enhancement signals at said grid.

2. The video display system according to claim 1, wherein said electron beams emitted by said plurality of electrodes correspond to red, green and blue signals.

3. The video display system according to claim 1, wherein said grid is a G1 grid in said cathode ray tube.

4. The video display system according to claim 1, wherein said enhanced viewing area comprises a user selectable area on said cathode ray tube.

5. The video display system according to claim 1, wherein said enhanced viewing area comprises a viewing area corresponding to a stored parameter.

6. The video display system according to claim 1, wherein said first and second control circuits are responsive to Video Electronics Standards Association (VESA) Monitor Command Control Set (MCCS) control parameters.

7. The video display system according to claim 6, wherein said VESA MCCS control parameters are encoded by a graphics processor, transmitted via a Display Data Channel 2/Command Interface (DDC2/CI) bus and received by a monitor processing unit operable to decode said VESA MCCS control parameters.

8. A method of generating an enhanced viewing area on a cathode ray tube video display, comprising:

generating a plurality of electron beams from a plurality of cathodes;

directing said plurality of electron beams toward a display surface operable to generate visible images in response to said electron beams; and controlling the plurality of electron beams by applying video enhancement signals to a grid between said plurality of electrodes and said display surface to generate an enhanced viewing area on a portion of said display surface; and using a delay circuit operable to delay arrival of control signals for generating said electron beams using said plurality of cathodes to coincide with the arrival of corresponding video enhancement signals at said grid.

9. The method according to claim 8, wherein said electron beams emitted by said plurality of electrodes correspond to red, green and blue signals.

10. The method according to claim 8, wherein said grid is a G1 grid in said cathode ray tube.

11. The method according to claim 8, wherein said enhanced viewing area comprises a user selectable area on said cathode ray tube.

12. The method according to claim 8, wherein said enhanced viewing area comprises a viewing area corresponding to a stored parameter.

13. The method according to claim 8, further comprising the steps of encoding Video Electronics Standards Association (VESA) Monitor Command Control Set (MCCS) control parameters in a graphics processor and transmitting said control parameters to a monitor processing unit via a Display Data Channel 2/Command Interface (DDC2/CI) bus.

14. The method according to claim 13, further comprising the step of decoding said VESA MCCS control parameters in said monitor processing unit and using said decoded VESA MCCS control parameters to apply video enhancement signals to said grid.

15. An information handling system, comprising:

a processor;

memory coupled to the processor, said memory including instructions to generate a user interface;

at least one cathode ray tube, comprising:

a plurality of cathodes at a first end of said cathode ray tube, said plurality of cathodes being operable to emit electron beams;

an anode at a second end of said cathode ray tube;

a display area at a second end of said cathode ray tube, said display area operable to generate a visible image in response to electron beams incident thereon; and at least one grid disposed between said plurality of cathodes and said anode, said grid being operable to control said electron beams thereby controlling the display characteristics of a visible image displayed on said cathode ray tube;

a first control circuit for controlling said plurality of cathodes; and a second control circuit operable to apply video enhancement signals to said grid at predetermined timing intervals to generate an enhanced viewing area on a portion of said display area of said cathode ray tube;

wherein said first control circuit comprises a delay circuit operable to delay arrival of video signal at said plurality of cathodes to coincide with the arrival of corresponding video enhancement signals at said grid.

16. The video display system according to claim 15, wherein said electron beams emitted by said plurality of electrodes correspond to red, green and blue signals.

17. The video display system according to claim 15, wherein said grid is a G1 grid in said cathode ray tube.

18. The video display system according to claim 15, wherein said enhanced viewing area comprises a user selectable area.

19. The video display system according to claim 15, wherein said enhanced viewing area comprises a viewing area corresponding to a stored parameter.

20. The video display system according to claim 15, wherein said first and second control circuits are responsive to Video Electronics Standards Association (VESA) Monitor Command Control Set (MCCS) control parameters.

* * * * *